US005684880A

United States Patent [19]

Lazzeroni et al.

[11] Patent Number: 5,684,880

[45] Date of Patent: Nov. 4, 1997

[54] NOISE CANCELLING MICROPHONE FOR FULL COVERAGE STYLE HELMETS

[76] Inventors: John J. Lazzeroni; Melinda K. Carevich, both of 1415 S. Cherry, Tucson, Ariz. 85713

[21] Appl. No.: 449,354

[22] Filed: May 24, 1995

[51] Int. Cl.[6] ..... H04R 25/00

[52] U.S. Cl. ..... 381/169; 381/155; 381/168; 381/91

[58] Field of Search ..... 381/168, 169, 381/122, 151, 183, 187, 87, 91, 155; 379/430

[56] References Cited

U.S. PATENT DOCUMENTS 4,885,773 12/1989 Stottlemyer et al. ..... 381/169
5,329,593 7/1994 Lazzeroni et al. ..... 381/168

*Primary Examiner*—Sinh Tran
*Attorney, Agent, or Firm*—Michael McClanahan

[57] ABSTRACT

Noise cancelling microphone construction for placement in a full coverage style helmet to secure and hold a noise cancelling microphone in the plenum between the inner liner and outer shell of the helmet, the construction having a front boot and a rear boot. The front boot has a speech receiving front open sleeve leading to front ports of the microphone, a flat annular flange attached to a cylindrical end of the front sleeve, and a second sleeve attached at one of its cylindrical ends to the other side of the flange, the second sleeve securing the front part of the microphone, the flange and second sleeve encompassing an opening in the helmet inner liner. A box formed on the front sleeve receives noise in the helmet environment, passes the noise through an opening in the annular flange and through the opening in the helmet inner liner. The rear boot has a cylinder with one closed end to hold and secure the rear part of the microphone, and an elongated sound passageway attached to its outside communicating with the cylinder interior through an opening. The sound passageway conducts noise from the front boot box to the rear ports of the held noise cancelling microphone. Thus noise present within the helmet environment is conducted to the noise cancelling ports of the microphone to cancel like noise entering the front ports of the microphone.

18 Claims, 2 Drawing Sheets

NOISE CANCELLING MICROPHONE FOR FULL COVERAGE STYLE HELMETS

BACKGROUND OF THE INVENTION

1. Field of the Invention

The field of the invention is microphones attached to full coverage style helmets worn by motorcycle riders for use in high wind and high noise environments such as occur when riding.

2. Description of the Related Art

In recent years, persons operating in high wind and noise environments, such as experienced by motorcycle riders, have enjoyed vast improvements in the communication ability to carry on conversations. This is especially true in respect to communications between the driver and passenger on the same motorcycle utilizing electronic apparatus as well as between a motorcycle driver and/or passenger with other motorcycle drivers and/or their passengers with radio transmitting and receiving apparatus, all while the motorcycles are moving and considerably distant from each other. Such improvements include the installation of noise cancelling microphones proximate the driver's and passenger's mouth by attachment to their respective motorcycle helmet, especially so when the attachment was to a boom connected to the lower lip of one of the sides of a one-half or three-quarter style motorcycle helmet. These are shown in the Inventors' prior invention entitled Noise Cancelling Microphone disclosed in U.S. Pat. No. 5,329,593.

However, we have noticed that in the full coverage style helmets, also known as the full face helmet, while the above cited noise cancelling microphone is a significant advance over the state-of-the-art existing there before, yet we are discovering that extraneous environmental noise is not entering the plenum between the inner liner or shell and the outer shell of the helmet through passageways in the quantities which most efficiently utilize the noise cancelling qualities of the microphone.

In full coverage style type helmets which enclose the head of the operator completely, outside viewing by the operator is accomplished through a plastic transparent face shield immediately in front of the occupant's face. While in many cases this transparent face shield is rotatable above the front opening of the helmet, in the usual riding scenario the face shield is in place over the opening.

Because of the construction of the full coverage style helmet in that it has a front or nose section, the helmet does not lend itself to utilizing a microphone in front of the operator's mouth, such as the one-half or three-quarter style helmet with its microphone mounted on a boom. As a result, the microphone must be attached to the front bottom portion of the helmet. Because of space consideration, the microphone must also invade the plenum between the inner liner and outer shell of the helmet.

If one were to analyze the acoustic environment in and around a motorcyclist's head while the motorcyclist is wearing the full coverage style helmet and riding a motorcycle, one would come to the conclusion that there are three principal acoustic environments.

The first acoustic environment is that surrounding the outside of the helmet which is principally the noise of air rushing by the helmet as well as the surrounding sounds, including the motorcycle engine. The outer shell of a helmet usually comprises a fiberglass or plastic material. Within the central cavity of the helmet which receives the operator's head is a second acoustical environment, most importantly the area immediately in front of the rider's face. This second acoustic environment extends from the rider's face to the surface of the inner liner and face shield of the helmet. This inner liner or shell comprises a compressible polystyrene type material to absorb energy in case of an accident. Present in this acoustic environment will be the voice of the rider as well as acoustic sounds which enter the bottom opening of the helmet, sounds of the motorcycle engine immediately below the rider together with sounds of air turbulence and other extraneous noise which have made it up into the helmet.

The third acoustic environment is the environment in the plenum between the inner liner and outer shell of the motorcycle helmet, which, as earlier mentioned, is acoustic noise which has entered the helmet via passageways communicating this plenum to the outside. While all three acoustic environments are different, they do have relationship to each other due to their proximity and the commonality of environmental acoustic sounds in the area.

Nevertheless, noise cancelling microphones operating on the principle that the same noise which impinges upon the front portion of the diaphragm of the microphone is permitted to simultaneously impinge upon the rear side of the diaphragm by entrance into the microphone housing through openings at the rear of the microphone to cancel each other out are effective. These microphones allow the primary sounds, usually the person speaking into the front of the microphone, to dominate the microphone output. With the full coverage style helmet the noise cancelling microphone is situated such that its front face, which allows sound to impact the front surface of the contained diaphragm, is open to the second environment immediately in front of the speaker's face. However, the rear portion of the microphone resides in the plenum formed between the inner liner and outer shell of the helmet. For the noise cancelling microphone to operate most effectively, the same extraneous environmental noise impacting the front of the microphone to its diaphragm must also impact the rear of the diaphragm and both inputs must be in phase in order for full cancellation.

Now it is true that sounds entering into the helmet from below, primarily engine sounds as well as air turbulence sounds, do enter the plenum between the inner liner and outer shell of the helmet, yet the acoustic environment existing within the plenum between the inner liner and outer shell of the helmet is not the exact same environment as at the front face of the microphone. As a consequence, the noise cancelling qualities of a microphone in a full coverage style helmet setting are not fully utilized with the full coverage style helmet as they are in the half or three-quarter style helmet with the microphone at the end of a boom.

It is realized that if the noise cancelling microphone were mounted completely within the second environment above described, e.g., between the speaker's mouth and face and the inside surface of the helmet immediately in front of the speaker's face, then generally the same acoustic environment would be presented to both the front and rear inlet passageways of the microphone housing, depending of course, on the orientation of the front and rear passageways. However, as a practical matter, microphones are mounted in openings or behind openings formed through the inner liner of the full coverage style helmet so that only the front face of the microphone is directly accessible to sounds inside the helmet. Microphone mounting where indicated is principally for two reasons, firstly that space is limited in the area between the rider's face and the inside liner of the helmet and secondly, a microphone protruding into the volume inside a helmet becomes a obstacle to the rider when he slips the helmet on and off.

Thus it becomes readily apparent that the qualities of a noise cancelling microphone such as that detailed in the Inventor' prior patent may be better utilized in a full coverage style helmet if the same exact extraneous acoustic environmental noise is simultaneously and in-phase presented to both the front and rear surfaces of the microphone diaphragm. As a consequence, a device to convey the same extraneous environmental noise in phase through the helmet inner liner to the rear of the noise cancelling microphone for noise cancelling use would be of great use in reducing noise picked up by the microphone.

SUMMARY OF THE INVENTION

The embodiment of the invention described consists of improvements to noise cancelling microphones for use in high wind and noisy environments, particularly for use by motorcyclists wearing full coverage style motorcycle helmets.

More particularly, these improvements comprise a device which acquires the extraneous environmental noises coming into the bottom opening of a full coverage style motorcycle helmet and conveys these sounds through the inner liner of the helmet to a noise cancelling microphone situated between the inner liner and outer shell of the helmet. Since these extraneous environmental noise sounds also enter the front entrance of the noise cancelling microphone along with the operator's voice, noise cancelling techniques may be utilized if the same exact in phase noise is presented simultaneously to the both front and rear side of the diaphragm contained in the microphone assembly. The invention described provides for presenting the same exact in phase extraneous environmental noise to the rear of the microphone diaphragm as is presented to the front of the microphone diaphragm.

The invention comprises means to acquire the same extraneous environmental noise directly and in line with the source emanating the noise as enters the front of the microphone, convey this noise through a formed passageway of soft pliable rubber to reduce multiple reflections of the sounds so that the same sound does not arrive at two or more different times, and then present this acoustical noise to the rear entrance way of the noise cancelling microphone for cancellations purposes at the microphone diaphragm.

The invention comprises two major elements which work in combination to secure the noise cancelling microphone in place between the inner liner and outer fiberglass shell of the helmet and to convey the noise from inside the helmet cavity to the rear of the contained noise cancelling microphone for entrance into the rear ports.

Specifically, the first major element consists of a front boot made of soft pliable rubber having two rubber annular sleeves with one each of their circular ends joined together on opposite sides of a planar annularly shaped radially extending flange. This annularly shaped flange which extends beyond the outside cylindrical surface of the largest sleeve, has a central opening which allows the interiors of the two annular sleeves to communicate. A first annular sleeve is slightly larger than a second annular sleeve, the first annular sleeve adapted to be open to the motorcycle operator's mouth to receive spoken words. The open end of this first annular sleeve may be cut back by the operator with a pair of shears so that a sufficient distance from the operator's mouth may be maintained to avoid the two touching.

The second annular sleeve of the front boot, situated on the opposite side of the annular flange, serves two purposes, the first securing the invention in place by having its outside cylindrical surface fitting snugly in an opening formed in the inner liner of the helmet. The second purpose is to receive for holding the front portion of the cylindrically shaped noise cancelling microphone housing. The microphone housing also fits snugly in the inner cylindrical surface of the second sleeve. Further, additional securing is obtained by means of an annular groove formed in the surface of the inner cylindrical surface of this second sleeve which receives an annular ridge formed on the microphone outside housing.

Formed in the front boot by breaking through the radially extending flange at the outer peripheral surface of the first annular sleeve is a rectangularly shaped box. This box has oppositely situated parallel sides extending outwardly from the outside cylindrical surface of the first sleeve and perpendicularly to the flange, with a third side parallel to the radially extending flange joining the two parallel sides. These three sides, in addition to the outside cylindrical surface of the first sleeve which provides a floor, forms the box. This box has two open sides providing the entrance for the incoming extraneous environmental noise sounds to cross the inner shell of the helmet.

The second element of the invention is the rear boot, a soft pliable rubber partially closed cylinder with one closed end and one open. The balance of the microphone housing, particularly the rear portion which contains the entrances for the acoustic noise to impinge on the rear of the diaphragm, resides snugly in the cylinder of this soft pliable rubber rear boot. To help secure the frictional fit of the microphone housing within the closed cylinder forming the rear boot, an annular groove is formed on the inner surface of the rear boot cylinder which mates with a circular ridge situated on he cylindrical outside surface of the microphone housing. This rear boot is located within the plenum formed by the inner liner and outer shell of the helmet. To help secure the rear boot in place in addition to holding onto the microphone housing, the rear circular surface of the rear boot has adhesively attached to it a looped type fastening material which mates with a hook type fastening material adhered to the inside wall of the outer shell.

Attached to the outside cylindrical surface of the rear boot and protruding in the direction of the cylinder's cylindrical axis is an elongated passageway for the extraneous environmental noise. This passageway, generally rectangular in cross-sections shape and length, comprises an elongated tube which extends through the opening formed in the inner liner of the helmet. It has a down extending lip at its terminus which resides against the inner liner surface proximate the head cavity. An opening is formed in the side of the rear boot closed cylinder at its closed end to communicate the interior of the closed cylinder to this passageway. Lastly, a second opening is formed in the side of the rear boot closed cylinder, also at its closed end, to allow passage of an electrical cord connecting to the microphone housing.

When assembling the invention, the passageway formed in the rear boot is aligned with the entrance box of the front boot so that a completed sound passageway is presented from the outside of the first annular sleeve (the helmet head cavity), into the entrance of the passageway, through the passageway, and to the rear of the contained noise cancelling microphone housing where its noise cancelling sound entrances are situated.

The round opening through the inner liner of the helmet is so modified as to accept the somewhat rectangularly shaped sides of the passageway.

In the preferred embodiment, when the invention is fully assembled, the entrance way formed by the combined front and rear boot is directed downward towards the source of the noise, and an L-shaped open cell foam rubber plug is inserted in the passageway to slow down movement of air molecules which would show up as a wind buffeting effect as well as to prevent entrance of sand and particles in the air, yet allowing the passage of the extraneous environmental noise. The same open cell type foam material is also formed into a disk and placed at the bottom of the first annular sleeve over the opening in the radially extending flange leading to the front of the contained microphone housing for the same reasons it was used in the passageway described above.

In an alternate embodiment, the first annular sleeve is shortened considerably and notches formed in its circumferential surface to accept the speech of the operator.

Accordingly, it is an object of the subject invention to provide means for conveying extraneous environmental noise from the inside of a full coverage style motorcycle helmet to the rear ports of a contained noise cancelling microphone.

It is another object of the subject invention to provide elements which secure a noise cancelling microphone proximate the operator's mouth, which elements permit the full utilization of the qualities of the noise cancelling microphone.

It is still another object of the subject invention to provide elements which, in addition to securing the noise cancelling microphone, also secure to the motorcycle helmet worn by an operator while aligning a contained noise cancelling microphone with the operator's mouth.

It is a further object of the subject invention to provide elements which permit orientation of a noise cancelling microphone to directionally acquire the environmental noise coming from its source.

Other objects from the invention will in part be obvious and will in part appear hereafter. The invention accordingly comprises the apparatus possessing the construction, combination of elements, and arrangement of parts which are exemplified in the following detailed disclosure and the scope of the Application which will be indicated in the Claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
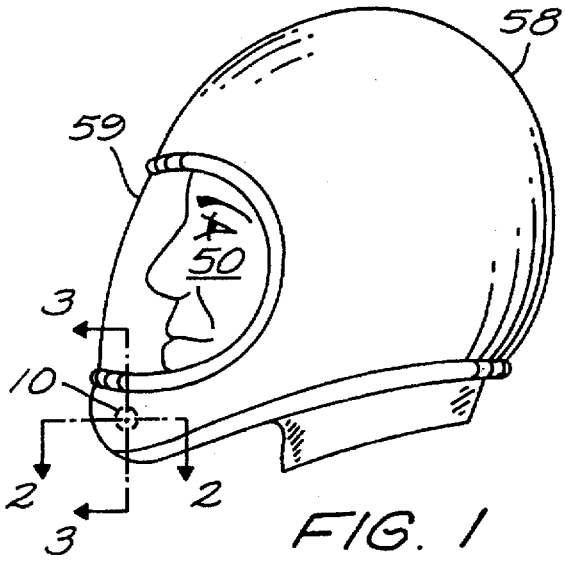
FIG. 1 is a side elevational view of a motorcycle rider wearing a full coverage style helmet.
Figure 6:
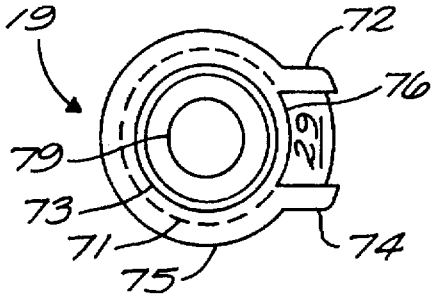
FIG. 6 is an end elevational view of the front boot of the subject invention.

Referring now to FIG. 1, a side view is shown of motorcycle rider or operator 50 wearing full coverage style helmet 58. Full coverage style helmet 58 completely encloses the head of operator 50 and allows the operator to view through front transparent shield or visor 59, which shield may be rotated upward. Shown in dotted form in the lower left hand portion of FIG. 6 is noise cancelling microphone assembly 10 of the present invention which, as seen, preferably resides slightly to the left (or right) of the operator's or rider's mouth. Noise cancelling microphone assembly 10 is not visible from the outside.

Figure 2:
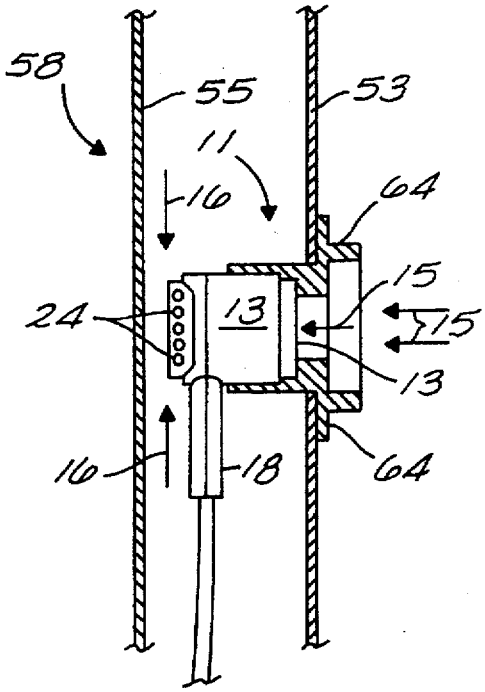
FIG. 2 PRIOR ART
FIG. 2 is a cross-sectional view of a prior art noise cancelling microphone situated in the full coverage style helmet.

FIG. 2 is a cross-sectional side view taken along sectional lines 2—2 of FIG. 1 of a prior art noise cancelling microphone assembly 11 such as illustrated in our prior patent. An opening is formed through inner liner 53 of helmet 58 which allows the insertion of the rubber sleeve or boot 64. Boot 64, in addition to residing tightly within the opening formed in inner liner 53, also secures in a snug relationship the front part of the housing of noise cancelling microphone 13. As a part of the prior art noise cancelling microphone assembly 11 and at the rear thereof are a plurality of openings 24 which, as explained in our previous patent, allows entrance of extraneous environmental noise to impinge on the rear surface of the diaphragm (not shown) situated within noise cancelling microphone 13. Of course there are openings in the front of noise cancelling microphone 13 which allow audio speaking sounds and extraneous environmental noise represented by arrows 15 into microphone 13 to impinge upon the front surface of the contained diaphragm. Noise and extraneous environmental sounds enter the plenum between inner liner 53 and outer shell 55 of the helmet through passageways situated at the lower peripheral rim and are shown by arrows 16, this noise proceeding on to enter rear openings 24 of microphone 13 where they cancel the same extraneous environmental noise at the diaphragm. Also shown in FIG. 2 is the electrical connecting cord 18 which transmits the electric signals generated by microphone 13.

Figure 3:
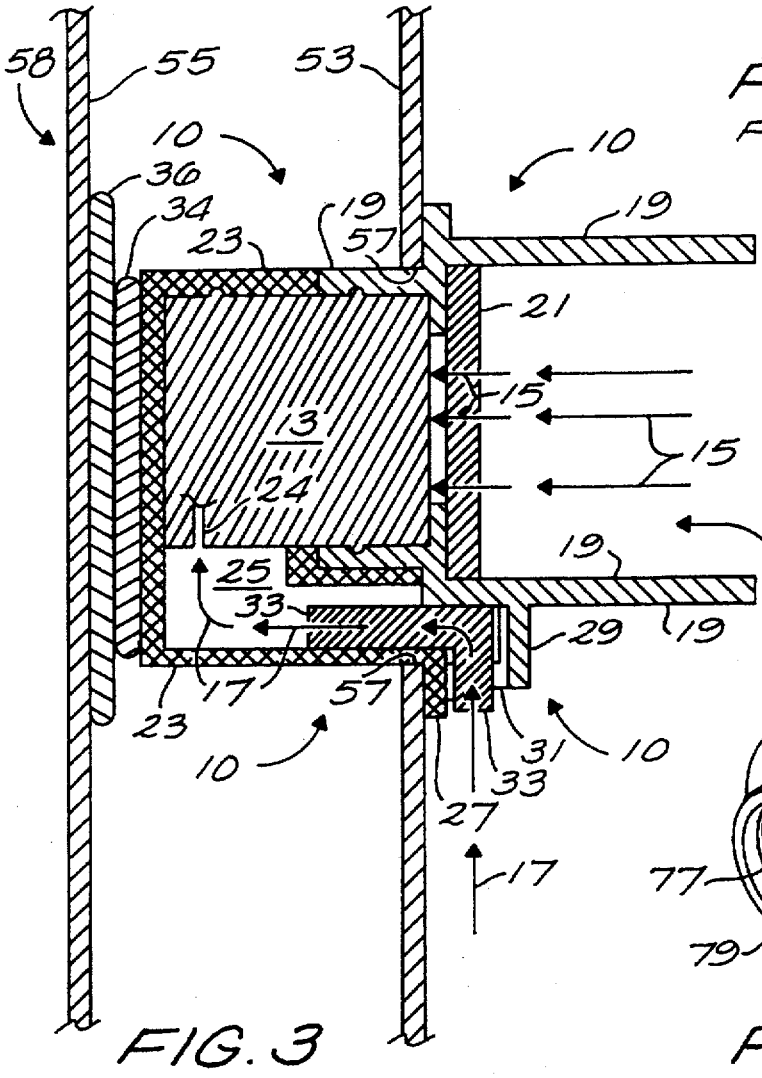
FIG. 3 is a cross-sectional view of the subject invention in place in a full coverage style helmet.

To avoid repetition of FIG. 1 for the purposes of showing our invention in place in a full coverage style helmet, FIG. 3 shows a cross-sectional view of the subject invention taken along sectional lines 3—3 of FIG. 1. Firstly shown is inner liner 53 and outer shell 55 of helmet 58 with centrally located noise cancelling microphone 13 within noise cancelling microphone assembly 10. At the rear of noise cancelling microphone 13 is shown one of the plurality of noise entering openings 24, here in a side view. It is noted that noise cancelling microphone 13 shown in FIG. 3 has been rotated ninety degrees from microphone 13 shown in FIG. 2. Commencing from the right hand side of the figure and moving left, front boot 19 is shown tightly engaging the sides of opening 57 formed in inner liner 53, front boot 19 securing the front part of the housing of microphone 13 in place. Front boot 19 comprises generally a first outside annular sleeve, open at one end with a reduced diameter opening at the other end. A second, smaller inside annular sleeve joins the first outside annular sleeve at the reduced diameter opening. The reduced diameter opening is contained in a radially directed flange which connects both sleeves and whose annular periphery extends beyond the first sleeve. Noise cancelling microphone assembly is directional with the first annular sleeve generally directed towards the operator's mouth.

It is intended that the operator insert the front boot second annular sleeve into the opening formed in the inner liner and then cut the first annular sleeve back to the point where it is comfortably spaced from the operator's mouth, yet catching the voice sounds of the operator. This also minimizes the extraneous environmental noise sounds entering the microphone front entrance. The incoming voice sounds from the operator, together with environmental noise, are shown by the arrows 15 entering the front of microphone 13. These sounds first pass through an open cell foam rubber disk 21 which is glued in place. This rubber disc does not have openings as might be implied from FIG. 1, but it does pass sounds quite readily while keeping dirt and wind from the microphone entrance. The cavity inside the second annular sleeve secures the front portion of the housing of microphone 13.

Securing the rear part of the housing of microphone 13 is rear boot 23 which, like the second annular sleeve of front boot 19, also holds microphone 13 in a rather snug configuration. Noted in both rear boot 23 and front boot 19 are respective annular grooves which mate with an annular ridges formed in the cylindrical sides of the housing of noise cancelling microphone 13. These two ridge and groove combinations assist the frictional fit of both boots to microphone 13. Rear boot 23 includes sound passageway 25, a longitudinal tunnel extending from an opening in the side of rear boot 23 to inside the head cavity of the helmet. This is better shown in FIGS. 4–9. At the forward end of rear boot 23 and at the entrance of passageway 25 is a downwardly extending lip 27. Setting just opposite lip 27 of rear boot 23 is another lip, namely lip 29 attached to the radially extending flange of front boot 19. Lip 27 and 29, together with side 31 (and a second side 32 not shown) form the entrance to passageway 25. Shown residing in the entrance and occupying a portion of the length of passageway 25 is "L" shaped foam rubber plug 53 which comprises an open cell rubber material (same as disk 21) and which blocks dust particles in the air and the wind, but conveys sound.

Attached to the rear circular surface of rear boot 23 is loop fastening material 34, attached by an adhesive. Similarly attached with an adhesive to the inside surface of outer shell 55 is hook fastening material 36. By means of these hook and loop fastening materials, the noise cancelling microphone assembly 10 is more securely held in place within the plenum of inner liner and outer shell 53 and 55 respectively and is assured that it will not move once installed.

Operation of inventive noise cancelling microphone assembly 10 is as follows. Primary acoustic sounds from the operator's mouth, together with noise and other extraneous environmental sounds which emanate into the full coverage style helmet from below, enter the front portion of the noise cancelling microphone assembly 10 as shown by arrows 15. There the audio sounds pass through open cell foam rubber disc 21 to enter front openings (not shown) of noise cancelling microphone 13, the microphone being of the type, for example, disclosed in our prior patent. These sounds impinge upon the front surface of the diaphragm contained in the microphone cartridge situated in microphone 13.

These same noise and other extraneous environmental sounds entering the bottom of the full coverage style helmet into the head cavity also enter passageway 25 of the inventive noise cancelling microphones assembly 10 shown by arrows 17. These noise sounds pass through open cell foam rubber plug 33 in passageway 25 to the rear portion of the passageway and from there enter rear openings 24 at the back of noise cancelling microphone 13. These noise and other extraneous sounds represented by arrows 17 impinge upon the rear side of the diaphragm (not shown) within microphone 13 to cancel out the same noise and other extraneous environmental sounds which entered the front portion (represented by arrow 15) of noise cancelling microphone 13. Thus, with the noise and other extraneous sounds remaining in phase, they cancel each other at the diaphragm, and only the operator's voice is transmitted by the output of noise cancelling microphone 13.

It is noted that when utilizing Applicant' noise cancelling microphone disclosed in their prior patent, only one of the rear entrance openings were needed to be utilized in the preferred embodiment. In Applicant' prior invention, these passageways located at the rear of the microphone exited the microphone housing in two opposite directions. In the usage of the microphone in the subject invention, those openings diagonally across from opening 24 shown in the FIG. 3 were sealed (as well as being tightly covered by the inside cylindrical surface of rear boot 23). In fact, in the preferred embodiment of the invention, it has been found convenient to block all of the rear openings shown by the numeral 24 except for one at time of manufacture. This is believed due to utilization of the passageway through both front and rear boots as the method the Applicants use to secure the same exact troubling environmental noise in the helmet cavity and convey it through the opening in the inner liner to the rear of the noise cancelling microphone. It is noted that while the invention has been specifically tailored to accept the Applicant' prior inventive noise cancelling microphone, the subject invention, with only minor obvious modifications, could be useful with other types of noise cancelling microphones.

Figure 4:
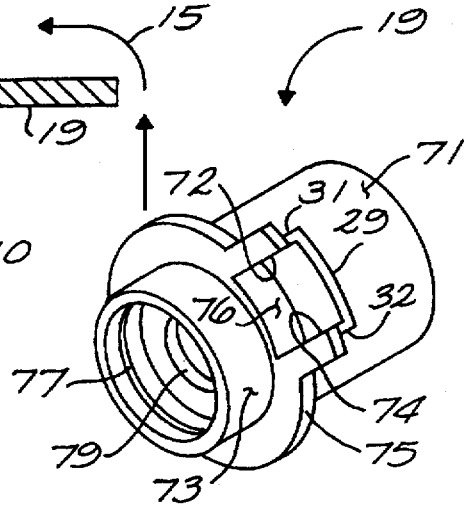
FIG. 4 is a perspective view of the front boot portion of the subject invention.

Referring now to FIG. 4, a perspective view of the soft rubber front boot 19 is shown. The primary components of front boot 19 are two round rubber sleeves, firstly, outside annular sleeve 71 which is situated inside the central head cavity of the full coverage style helmet 58 (FIGS. 1–3) and which receives the operator's voice and the extraneous environmental noise present. At the rear portion of front boot 19 is second annular sleeve 73 which tightly contacts the opening formed in the helmet inner liner to protrude into the plenum between the inner liner and outer shell of the helmet. The noise cancelling microphone 13 (FIGS. 2 and 3) partially resides within the interior of second annular sleeve 73. Connecting to respective ends of first annular sleeve 71 and second annular sleeve 73 is radially extending flange 75 which seats against the surface of inner liner 53 facing the head cavity of the helmet. Interiorly to the inside cylindrical surface of second annular sleeve 73 is annular grove 77, which, working with an annular protruding ridge formed in the housing of the noise cancelling microphone 13, helps secure the frictional fit of the two together. Lastly, formed in radially extending flange 75 and between first and second sleeves 71 and 73 is a reduced diameter opening 79, the wall forming the opening serving as a forward securing stop for noise cancelling microphone 13. Opening 79 permits the primary sound waves from the operator (along with extraneous environmental noise) into the microphone input itself.

Radially extending flange 75, which buffers first annular sleeve 71 to second annular sleeve 73, is interrupted in a small portion at its periphery to form the beginning of the passageway which permits extraneous environmental noise coming into the head cavity to migrate to the rear openings of the noise cancelling microphone. More specifically, this peripheral break in radially extending flange 75 is cut away with oppositely situated radially extending pillars 72 and 74. Connected to these outwardly extending pillars are sides 31 and 35, these sides then terminating into rear lip 29. Floor 76 of the formed passageway is the outside cylindrical surface of first annular sleeve 71. The four sides described form a box with two open sides.

Figure 5:
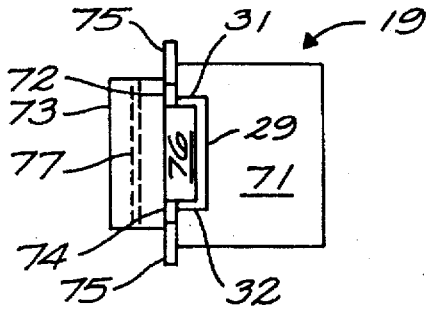
FIG. 5 is a top elevational view of the front boot of the subject invention.

FIG. 5 is a top elevational view of front boot 19 showing first annular sleeve 71 and second annular sleeve 73. Joining these two sleeves is radially extending flange 75. Also seen in the top view of FIG. 5 are those elements which form the entrance of the passageway for noise and other extraneous sounds to begin its journey to the rear parts of the noise cancelling microphone, namely lip 29, sides 31 and 32, floor 76 as well as the tops of radially extending pillars 72 and 74. Lastly, shown in dotted form since it is on the inside of second annular sleeve 73 is annular groove 77.

Referring now to FIG. 6, an end elevational view of front boot 19 is shown taken from the end showing second annular sleeve 73. Starting from the inside, first shown is reduced diameter opening 79 which permits entrance of primary sound waves to the noise cancelling microphone. Next is the end wall of sleeve 73 showing its thickness. Following, shown in dotted form is the exterior cylindrical surface of first annular sleeve 71. Continuing outwardly is the peripheral circular edge of radially extending flange 75. Lastly, at the upper part of front 19 are the components which contribute to make up the sound passageway, namely the two outwardly extending pillars 72 and 74, lip 29 at the rear, and the rounded surface of floor 76. Not seen are the two sides 31 and 32.

In the preferred embodiment, the inner diameter of first annular sleeve 71 is the same diameter as the outer diameter of second annular sleeve 73.

Figure 7:
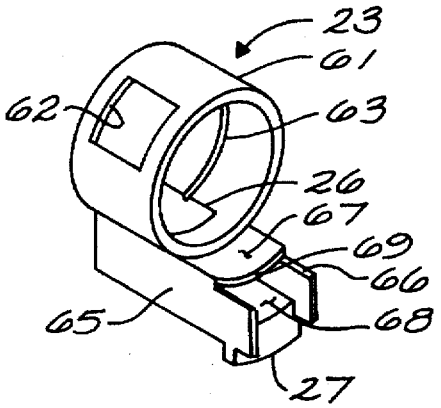
FIG. 7 is a perspective view of the rear boot portion of the subject invention.

Next, FIG. 7 details a perspective view of rear boot 23, which like front boot 19, is made from soft pliable rubber. In the perspective view shown in FIG. 7, rear boot 23 comprises cylinder 61, one end of which is closed and the other end open, the inside cylindrical surface of which receives the rear portion of noise cancelling microphone 13 housing. Opening 62 through the cylindrical side of cylinder 61 permits the passage of electrical cord 18 (FIG. 2) connecting to the noise cancelling microphone. Interiorly to closed cylinder 61 is firstly formed annular groove 63 adapted to receive an annular ridge formed in the housing of noise cancelling microphone 13 to more securely hold rear boot 23 around the cylindrical surface of the microphone housing. Secondly, formed into the wall of closed cylinder 61 at the bottom thereof, is opening 26 communicating with noise and extraneous sound passageway 25 shown in FIG. 3.

Extraneous environmental sound passageway 25 formed in rear boot 23 comprises parallel sides 65 and 66, curved top 67, and bottom 68. Passageway 25, terminating into opening 26 of closed cylinder 61, has its entrance at the far right end shown in FIG. 7. Lip 27 extends vertically downward from the curved bottom 68 to defined one side of the entrance. Curved top 67 resides against the outside cylindrical surface of second annular sleeve 73 and its end 69 abuts radially extending flange 75 of front boot 19 just below the entrance to floor 76 shown in FIG. 4. The inside surface of lip 27 engages the outside surface of helmet inner liner 53 as shown in FIG. 3.

Figure 8:
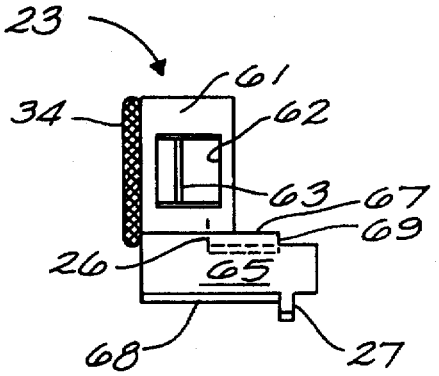
FIG. 8 is a side elevational view of the rear boot of the subject invention.

Referring now to FIG. 8, a side elevational view of rear boot 23 is shown illustrating from the top, closed cylinder 61, opening 62 for the electrical cord which connects to an enclosed microphone (not shown), and annular groove 63. At the rear of closed cylinder 61 is loop fastening material 34, a round disc of the fastening material, attached by an adhesive to the soft pliable rubber of rear boot 23. Immediately below and formed as a single unit is side 65 of the sound passageway with curved bottom 68 and curved top 67. At the end of curved top 67 is end 69. Lastly shown is down extending lip 27. Shown in dotted form is opening 26 leading to the extraneous environmental sound passageway as well as the undersurface of curved top 67.

Figure 9:
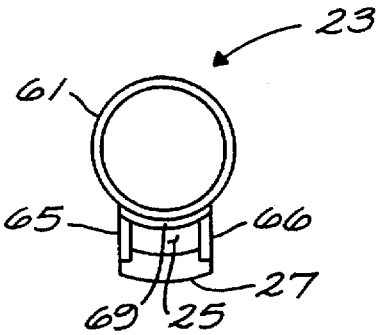
FIG. 9 is an end elevational view of the rear boot of the subject invention.

Referring now to FIG. 9, an end elevational view of rear boot 23 is shown comprising firstly closed cylinder 61 and immediately below cylinder 61, end 69 of the curved top of the passageway. Passageway 25 is seen in this view together with parallel sides 65 and 66. At the bottom is lip 27.

Figure 10:
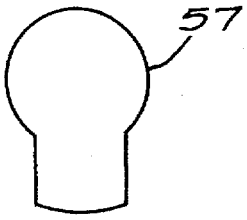
FIG. 10 is a drawing of the opening which is formed in the inner liner of the full coverage style helmet.

Lastly shown in FIG. 10 is the shape of preferred opening 57 formed in inner liner 53 of helmet 58. For the ease of comparison, opening 57 shown in FIG. 10 is drawn to the same scale as rear boot 23 shown in FIG. 9 since the outside diameter of closed cylinder 61 of rear boot 23 is the same outside diameter as cylinder 73 of front boot 19. Accordingly, the diameter of opening 57 will be the same. In addition, the lower portion of opening 57 has been enlarged to receive sides 65 and 66 as well as bottom 68 which form passageway 25 in rear securing boot 23.

It is obvious from the size of radially extending flange 75 which abuts the sides of the opening in the inner liner that a single round hole may also be used. In such case, the diameter of the hole needs to be equal to the distance from the top of outside cylindrical surface of sleeve 73 to the outside curved surface of bottom 68 of rear boot 23.

Lastly, foam rubber plug 33 (FIG. 3) is shaped to fit within passageway 25 and extend down out in its entrance.

Figure 11:
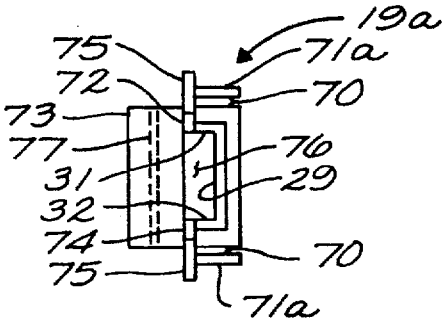
FIG. 11 is a top elevational view of an alternate embodiment of the front boot portion of the subject invention.

An alternate embodiment of a portion of the invention, namely front boot 19 is shown in FIG. 11 wherein front boot **19*a* has been modified in accordance with earlier discussed procedures. More particularly, front boot 19*a* reflects circumferential cutting by shears of the first outside annular sleeve 71 so as to reduce obstacles to an operator placing the helmet on his head and adjustment for the distance between the operator's mouth and the front boot. In addition to front boot 19*a* longitudinal length being shortened to just beyond the outside of lip 29, annular sleeve 71*a* has been further cut to form notches into its wall. These notches 70 are cut into the walls totally around the circumference. This serves to allow the operator's voice to also enter the microphone through these tooth cuts or notches. The outside environmental sounds, coming up from the bottom primarily still enter the passageway formed by walls 31 and 32, and lip 29. Although not shown in FIG. 11, open cell foam rubber disk 21 (FIG. 3) is still situated at the base or bottom of sleeve 71*a***, attached by means of an annular layer of adhesive.

The embodiment shown in FIG. 11 has proven for many individuals to be of advantage when wearing the helmet for the reasons cited above.

While the invention has been described, disclosed, illustrated, and shown in certain terms or certain embodiments or modifications which it has assumed in practice, the scope of the invention is not intended to be, nor should it be deemed to be, limited thereby and such other modifications or embodiments as may be suggested by the teachings herein are particularly reserved, especially as they fall within the breath and the scope of the claims here appended.

We claim:

1. Noise cancelling microphone construction for use in a full coverage style helmet worn by an operator to reduce the effects of environmental noise and other extraneous sounds present inside the helmet upon the speech of the operator into the noise cancelling microphone, the helmet of the type having an inner liner encompassed by an outer shell with a plenum therebetween, the noise cancelling microphone residing substantially in the plenum, the noise cancelling microphone of the type having rear ports located in the rear portion of the microphone housing to receive noise for cancellation of like noise entering through ports in the front portion of the microphone housing, said noise cancelling microphone construction comprising:

a front boot operably attached to the helmet inner liner, said front boot receiving and securing the front portion of the noise cancelling microphone housing, said front boot also including means for conducting the environmental noise and other extraneous sounds present inside the helmet to the rear ports of the noise cancelling microphone; and a rear boot situated substantially in the plenum between the helmet inner liner and the helmet outer shell, said rear boot receiving and securing the rear portion of the noise cancelling microphone housing, said rear boot also including means for conducting the environmental noise and other extraneous sounds present inside the helmet to the rear ports of the noise cancelling microphone wherein the environmental noise and other extraneous sounds present inside the helmet and entering the front of the noise cancelling microphone are cancelled by the same environmental noise and other extraneous sounds entering the rear ports of the noise cancelling microphone.

2. The noise cancelling microphone construction as defined in claim 1 wherein said means for conducting the environmental noise and other extraneous sounds of said front boot acts co-jointly with said means for conducting the environmental noise and other extraneous sounds of said rear boot.

3. The noise cancelling microphone construction as defined in claim 2 wherein said front boot defines an annually shaped flange having a first flat side and an opposite second flat side, a front sleeve, and a rear sleeve, said front sleeve attached to said first flat side of said annular flange and said rear sleeve attached to said second flat side of said annular flange, said front sleeve directed to receive the speech of the operator.

4. The noise cancelling microphone construction as defined in claim 3 wherein the helmet inner liner includes an opening therethrough, and said rear sleeve and said second flat side of said annular flange operably engage the opening through the helmet inner line in a secure arrangement.

5. The noise cancelling microphone construction as defined in claim 4 wherein said annular flange has a central opening, said central opening communicating said first sleeve to said second sleeve, said central opening exposing the front ports of the noise cancelling microphone to the first sleeve and to the speech of the operator.

6. The noise cancelling microphone construction as defined in claim 5 wherein said means for conducting the environmental noise and other extraneous sounds of said front boot include a box construction attached to said first flat side of said annular flange and to said first sleeve, said box construction acting co-jointly with said means for conducting the environmental noise and other extraneous sounds of said rear boot.

7. The noise cancelling microphone construction as defined in claim 6 wherein said box construction of said front boot includes a plurality of side walls protruding radially from said first sleeve, two of said plurality of side walls connected to said annular flange, said side walls defining a box open on at least one side to receive the environmental noise and other extraneous sounds present in the helmet.

8. The noise cancelling microphone construction as defined in claim 7 wherein said annular flange includes a second opening therethrough, said second opening communicating with said box construction to allow passage of the environmental noise and other extraneous sounds through said annular flange.

9. The noise cancelling microphone construction as defined in claim 8 wherein said rear boot defines a cylinder with cylindrical walls and one closed end, said cylinder receiving and securing the rear portion of the noise cancelling microphone housing, and said means for conducting the environmental noise and other extraneous sounds of said rear boot include an elongated sound conducting passageway attached to said cylinder.

10. The noise cancelling microphone construction as defined in claim 9 further including a first opening through said cylindrical walls, said first opening communicating said cylinder to said sound passageway wherein sounds in said sound passageway enter said cylinder and into the rear ports of the noise cancelling microphone.

11. The noise cancelling microphone construction as defined in claim 10 wherein said sound passageway includes a perpendicularly extending lip, said lip engaging the opening through the helmet inner liner inside the helmet.

12. The noise cancelling microphone construction as defined in claim 11 wherein said lip co-acts with said box construction of said front boot to define a front entrance to said box construction for the entrance of the environmental noise and other extraneous sounds wherein noise presence in the helmet may enter the box construction, pass into said sound passageway of said rear boot to said first opening in said cylinder of said rear boot, and into the rear ports of said noise cancelling microphone in order to cancel like noise entering the front ports of the noise cancelling microphone.

13. The noise cancelling microphone construction as defined in claim 12 further including fastening means, said fastening means interposed said closed end of said cylinder of said rear boot and the helmet outer shell, said fastening means securing said rear boot to the helmet outer shell.

14. The noise cancelling microphone construction as defined in claim 8 wherein said second sleeve includes an annularly shaped groove formed therein, said annularly shaped groove encompassing an annularly shaped ridge on the noise cancelling microphone housing to help secure the front portion of the noise cancelling microphone housing in said second sleeve.

15. The noise cancelling microphone construction as defined in claim 12 wherein said cylinder includes an annularly shaped groove formed therein, said annularly shaped groove encompassing an annularly shaped ridge on the rear portion of the noise cancelling microphone housing to help secure the noise cancelling microphone in said cylinder.

16. The noise cancelling microphone construction as defined in claim 12 wherein said cylinder includes a second opening formed in said cylindrical walls of said cylinder, said second opening of said cylinder permitting the passage of electrical wires emanating from the noise cancelling microphone.

17. The noise cancelling microphone construction as defined in claim 12 wherein said front boot and said rear boot comprise pliable material.

18. The noise cancelling microphone construction as defined in claim 17 wherein said first sleeve has a length, said length is adjusted by cutting, and is adjustable to the desires of the operator.

* * * * *